US010513878B2

(12) United States Patent
Skyum et al.

(10) Patent No.: US 10,513,878 B2
(45) Date of Patent: Dec. 24, 2019

(54) METHOD FOR ATTACHING A PANE ELEMENT TO A SASH AND A PANE MODULE INCLUDING A PANE ELEMENT

(71) Applicant: VKR Holding A/S, Hørsholm (DK)

(72) Inventors: Asbjørn Blichfeldt Skyum, Odder (DK); Lars Klausen, Ringe (DK); Sten Rasmussen, Andkær (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 15/874,042

(22) Filed: Jan. 18, 2018

(65) Prior Publication Data

US 2018/0230733 A1 Aug. 16, 2018

(30) Foreign Application Priority Data

Feb. 15, 2017 (DK) ..... 2017 70100

(51) Int. Cl.
*E06B 3/54* (2006.01)
*E06B 1/36* (2006.01)
*E06B 1/30* (2006.01)

(52) U.S. Cl.
CPC ..... *E06B 3/5409* (2013.01); *E06B 1/30* (2013.01); *E06B 1/36* (2013.01)

(58) Field of Classification Search
CPC ..... E06B 3/66328; E06B 3/54; E06B 3/66; E06B 3/6625; E06B 3/6621; E06B 3/663
See application file for complete search history.

(56) References Cited

U.S. PATENT DOCUMENTS 2,000,522 A 5/1935 Kaspar
2,574,736 A 11/1951 Gerow
(Continued)

FOREIGN PATENT DOCUMENTS

DE 4010081 10/1991
DE 4305283 4/1994
(Continued)

OTHER PUBLICATIONS

Extended European Search Report dated Jun. 21, 2018 issued in EP Application No. 18156571, 11 pages.
(Continued)

*Primary Examiner* — Gisele D Ford
(74) *Attorney, Agent, or Firm* — Merek, Blackmon & Voorhees, LLC

(57) ABSTRACT

Disclosed is a method for attaching a pane element to a sash, including the steps of A) providing a pane element with a border element, thereby making a pane module, and B) bringing a contact surface of the border element into contact with a contact surface of the sash, and connecting the pane module to the sash. Further disclosed a pane module comprising a pane element and a border element, where the border element includes a contact surface adapted for being connected to a contact surface of the sash, wherein the contact surface of the border element is adapted for being connected to the contact surface of the sash by means of an adhesive or glue, where the border element includes one or more elongate support member(s), and where the border element comprises guiding elements projecting from the contact surface of the border element substantially perpendicularly to the pane plane, wherein the guiding elements are adapted for being inserted in openings in the contact surface of the sash.

11 Claims, 8 Drawing Sheets

(56) References Cited

U.S. PATENT DOCUMENTS

| | | | | |
|---|---|---|---|---|
| 2,878,864 | A | 3/1959 | Fletcher | |
| 3,358,412 | A | 12/1967 | Martin | |
| 3,872,198 | A * | 3/1975 | Britton | E06B 3/56 156/109 |
| 4,822,649 | A * | 4/1989 | Canaud | E06B 3/6621 428/34 |
| 4,951,927 | A * | 8/1990 | Johnston | E06B 3/20 264/129 |
| 5,061,531 | A * | 10/1991 | Catalano | E06B 3/20 156/107 |
| RE35,149 | E * | 1/1996 | Richardson | A47F 3/043 49/501 |
| 6,216,417 | B1 | 4/2001 | Morin et al. | |
| 6,640,508 | B2 * | 11/2003 | Lindgren | E04D 13/02 49/504 |
| 6,647,676 | B1 * | 11/2003 | Hansen | E04D 13/0357 52/200 |
| 8,499,508 | B2 * | 8/2013 | Sonderkær | E06B 3/66 52/204.593 |
| 8,789,323 | B2 * | 7/2014 | Rasmussen | E04B 2/90 52/204.5 |
| 8,943,769 | B2 | 2/2015 | Sonderkaer et al. | |
| 9,016,009 | B2 | 4/2015 | Sonderkaer et al. | |
| 9,016,010 | B2 | 4/2015 | Sonderkaer et al. | |
| 9,051,775 | B2 | 6/2015 | Kristensen et al. | |
| 9,115,536 | B2 | 8/2015 | Sonderkaer et al. | |
| 9,376,852 | B2 | 6/2016 | Sonderkaer et al. | |
| 9,453,363 | B2 | 9/2016 | Sonderkaer et al. | |
| 9,453,364 | B2 | 9/2016 | Sonderkaer et al. | |
| 2002/0056184 | A1 * | 5/2002 | Richardson | A47F 3/0434 29/458 |
| 2004/0139669 | A1 * | 7/2004 | Feucht | E04D 13/02 52/204.1 |
| 2007/0186495 | A1 * | 8/2007 | Guillemette | E06B 3/44 52/204.51 |
| 2010/0199591 | A1 * | 8/2010 | Sonderkaer | E06B 3/5427 52/656.6 |
| 2010/0205879 | A1 * | 8/2010 | Sonderkær | E06B 3/5427 52/204.593 |
| 2010/0205881 | A1 * | 8/2010 | Sonderkaer | E04D 12/002 52/209 |
| 2011/0011002 | A1 * | 1/2011 | Guillemette | E06B 3/44 49/394 |
| 2012/0023828 | A1 * | 2/2012 | Kristensen | E06B 3/6621 49/398 |
| 2012/0137607 | A1 * | 6/2012 | Kristensen | E04D 13/0354 52/204.62 |
| 2013/0236661 | A1 * | 9/2013 | Kamaka | B61D 25/00 428/34 |
| 2014/0186556 | A1 * | 7/2014 | Dear | E06B 3/26345 428/34 |
| 2014/0230349 | A1 * | 8/2014 | Rasmussen | E04D 13/031 52/200 |
| 2014/0259942 | A1 * | 9/2014 | Koed | E04D 13/0354 49/397 |
| 2014/0366452 | A1 * | 12/2014 | Viig | E04D 13/0354 49/400 |
| 2015/0020465 | A1 * | 1/2015 | Saunders | E06B 1/6007 52/204.6 |
| 2015/0096257 | A1 * | 4/2015 | Sinnathamby | E06B 3/205 52/656.2 |
| 2016/0138323 | A1 * | 5/2016 | Sønderkær | E06B 3/5427 52/173.1 |
| 2017/0016271 | A1 * | 1/2017 | Boucher | F25D 23/028 |
| 2017/0226797 | A1 * | 8/2017 | Birkkjaer | E06B 9/52 |
| 2017/0275876 | A1 * | 9/2017 | Mucha | E04B 7/18 |
| 2018/0245341 | A1 * | 8/2018 | Boucher | E06B 3/663 |

FOREIGN PATENT DOCUMENTS

| | | |
|---|---|---|
| EP | 0103766 | 3/1984 |
| EP | 0207870 | 1/1987 |
| EP | 0384462 | 2/1990 |
| EP | 1681400 | 7/2006 |
| EP | 1760220 | 3/2007 |
| EP | 2481864 | 8/2012 |
| FR | 2916464 | 11/2008 |
| WO | WO02/06621 | 1/2002 |
| WO | WO2004055294 | 7/2004 |
| WO | WO2010/088904 | 8/2010 |

OTHER PUBLICATIONS

Danish Office Action dated Jan. 29, 2018 issued in Danish Patent Application No. PA201770881, 8 pages.

Danish Additional Search Report dated Mar. 12, 2018 issued in Danish Patent Application No. PA201770881, 1 page.

Danish Office Action dated Mar. 15, 2018 issued in Danish Patent Application No. PA201770881, 4 pages.

Machine translation of EP0207870.

Machine translation of EP1681400.

Machine translation of DE4305283.

Machine translation of EP0103766.

Machine translation of FR2916464.

Machine translation of DE4010081.

Machine translation of EP0384462.

Danish Search Report dated Aug. 9, 2017 issued in Danish Patent Application No. PA201770100, 1 page.

* cited by examiner

METHOD FOR ATTACHING A PANE ELEMENT TO A SASH AND A PANE MODULE INCLUDING A PANE ELEMENT

RELATED APPLICATION

The subject patent application claims priority from Danish patent application PA 2017 70100 filed on Feb. 15, 2017 the entire contents of which are incorporated herein by reference.

FIELD OF THE INVENTION

The present invention relates to a method for attaching a pane element to a sash, including the steps of A) providing a pane element with a border element, thereby making a pane module, and B) bringing a contact surface of the border element into contact with a contact surface of the sash, and connecting the pane module to the sash. The invention further relates to a pane module comprising a pane element and a border element, where the pane element includes at least two sheet elements, such as sheets of glass, separated by one or more spacer members, where an interior side of the pane element is intended to face the interior of a building in the mounted state and defines a pane plane, where the border element surrounds the pane element, at least partially encasing an edge of at least one sheet element, and where the border element is made by moulding and attached to the pane element during the moulding process.

BACKGROUND OF THE INVENTION

When glazing vertical windows as well as roof windows the pane element is usually connected to a glass-carrying frame, i.e. traditionally the sash, by means of glazing profiles fastened to the frame by means of screws. The pane element is kept in place by means of glass spacers and glazing clips. Though it has proven very efficient, this method suffers from a number of disadvantages, among others the large number of different parts needed for the glazing, and the fact that the discontinuous support may cause potentially destructive strains on the pane element, particularly when using a conventional glass sheet pane element. This influences the lifespan of the pane element with respect to breakage and failure in the pane sealing, the latter resulting in the formation of condensation in the space between the sheet elements.

More recently, attempts have been made to provide the pane element with a moulded border element, thereby forming a pane module, and attaching the border element to the frame. A pane module of this type, which is known from WO2010/088904, allows a greater flexibility in the production of windows, as fewer parts are needed, and the moulded border element provides a continuous support along the entire edge of the pane element, thereby allowing a much higher degree of freedom in designing the sash and/or frame members. Certain functions previously associated with the sash and/or frame members, such as load bearing, may be wholly or partially taken over by the border element and a great variety of window products may be achieved by combining different pane modules and different sash and/or frame members in different ways.

A similar solution to the problem of securing a pane element without using traditional parts has been provided in EP0384462, where dowels projecting from a border element are fixated in counterparts in the sash. Nevertheless, many issues are still remaining. The dowels and counterparts provided in EP0384462 from thermal bridges extending into the sash, thereby influencing the insulation properties of the sash negatively. Furthermore, the design criteria relating to strength and mechanical properties of the pane module require that the border element has to be quite bulky at the dowels, and the sash must be made of a relatively strong material in order to take up the loads from the dowels.

Even though the arrangements disclosed in these documents facilitate the mounting of the pane element, reduce the number of parts and to some extend provide a safer installation, there is still a need for facilitating the installation, improving the insulation properties of the resulting window assembly, and allow for more flexible solutions.

SUMMARY OF THE INVENTION

With this background it is an object of the invention to provide a method for attaching a pane element to a sash, allowing the insulation properties of the resulting window assembly to be improved. Another object is to provide an improved pane module.

In a first aspect, this and further objects are met by a method as described above, where, during step A), one or more elongate support members is/are arranged to extend along one or more sides of the pane element and embedded in the material of the border element during the moulding process, and where step B) includes the following steps: B1) providing the contact surface of the border element and/or of the sash with an adhesive or glue; B2) inserting guiding elements of the border element in openings in the contact surface of the sash, said guiding elements projecting from the contact surface of the border element; and B3) keeping the contact surface of the border element in contact with the contact surface of the sash until the adhesive or glue has set or hardened.

By attaching the pane module to the sash by means of an adhesive or glue, instead of for example using mechanical fasteners such as dowels or screws, the formation of thermal bridges is avoided and better insulating properties are achieved. Moreover, the adhesive or glue may serve as a sealing preventing humidity from penetrating into the joint between the border element and the sash. On top of that, the use of adhesive or glue also permits to make sashes and border elements more slender, thus potentially increasing the window pane-to-sash ratio.

The guiding elements serve to ensure a correct positioning of the pane module in relation to the sash and to keep the pane module in place until the adhesive or glue has set or hardened, thus allowing the window assembly to be handled and possibly even installed, even though the adhesive or glue has not yet set or hardened completely. This not only allows an optimization of the production process but also allows the use of alternative adhesives and glues, which would previously have been rejected even though they had other advantageous properties, such as for example being environmentally friendly. Moreover, as the requirements for their load-bearing capacity are limited, the guiding elements can be made of materials with a low thermal conductivity, such as wood or light-weight polymers, which are typically also relatively cheap.

A still further advantage is that the sash can be made from virtually any suitable material, including insulation materials, which would not have been capable of supporting a pane module attached by means of dowels or screws. This not only allows the making of window assemblies with improved insulating properties but also allows a large degree of flexibility in the design of the window assembly.

The provision of the elongate support member(s) provides additional strength and stiffness to the pane module and ensures the integrity of the border element and contributes to distributing loads acting on the border element. This for example means that the elongate support member can take up tensional loads during the handling of the pane module in step B), and that local loads acting on the pane module when installed in a window assembly will be distrusted and affect the joint provided by the adhesive or glue more evenly.

In one embodiment the elongate support member(s) is/are arranged at the contact surface of the border element, and preferably at least partially exposed in the finished state of the pane module so that it comes into contact with the adhesive or glue during step B. Positioning the elongate support member(s) close to the sash is advantageous with respect to its function as reinforcement, and by being exposed the elongate support member may provide the contact surface of the border element with advantageous surface properties, which might be difficult to achieve with the moulding material used for forming the border element.

For increasing the contact area between the adhesive or glue and the elongate support member, said elongate support member may comprise recesses for accommodating adhesive or glue. This will also potentially allow an excess of adhesive or glue to be accommodated within the border element rather than coming out onto the visible surface of the window assembly. The moulded part of the border element may also be provided with recesses for accommodating adhesive or glue.

In order to provide a continuous support, said elongate support member(s) preferably extend(s) substantially along the entire length and/or width of the pane element, and possibly even over the entire length and/or width of the border element. In one embodiment, elongate support members are arranged along the two opposite sides of the pane element, which are intended to extend along the sides of the window assembly in the mounted state, i.e. extending from the top of the window to the bottom of the window. In another embodiment elongate support members extend along the intended top and bottom members of the border element. The former embodiment is particularly well suited for use in center-hung windows, and the latter embodiment is particularly well suited for use in top-hung windows.

The guiding elements can be inserted through one or more holes in the elongate support member. This contributes to keeping the guiding elements in place during moulding of the border element and provides a structural integration of the elongate support member with the guiding elements. Such a structural integration reduces the risk of the guiding elements being pulled away from their intended position during or after insertion in the openings in the sash, and allows a transmission of loads from the guiding elements to the elongate support member until the adhesive or glue has set or hardened.

The elongate support member(s) may further comprise one or more holes adapted for receiving one or more screws or like fasteners for a temporary fastening of the border element to a sash. These will serve to keep the pane module in place until the adhesive or glue has set or hardened, thereby relieving the loads on guiding elements, and if left in place they will serve as a safety measure by keeping the pane module in place even if the adhesive or glue should become weak due for example to chemical deterioration or under the influence of heat from a fire.

In order to keep the contact surface of the border element in contact with the contact surface of the sash until the adhesive or glue has set or hardened, the guiding elements can be brought into a tensioned engagement with inside surfaces of said openings during step B2), said inside surfaces being substantially perpendicular to the sash contact surface. This can be achieved simply by using guiding elements, which are slightly over-size in relation to the openings, but it is also possible to use guiding elements where the part for the guiding elements, which is adapted for being inserted in the openings, is provided with barbs or the like.

Barbs, resilient arms etc. may also be used for keeping the guiding elements in place in relation to the elongate support member, when they are inserted through holes therein as described above.

In a second aspect of the invention the objects are achieved with a pane module where the contact surface of the border element is adapted for being connected to the contact surface of the sash by means of an adhesive or glue; where the border element includes one or more elongate support member(s); and where the border element comprises guiding elements projecting from the contact surface of the border element substantially perpendicularly to the pane plane, said guiding elements being adapted for being inserted in openings in the contact surface of the sash.

The advantages described with reference to the method above also applies to the pane module according to the invention, and the additional advantages of specific embodiments of the pane module described below also applies to the method unless otherwise stated.

The material, amount and dimensions of the projecting guiding elements should be suited to temporarily support the pane element. In one embodiment, the length of said guiding elements in a longitudinal direction, which is substantially perpendicular to the pane plane, is between 1 and 100 mm, preferably between 8 and 80 mm and most preferably between 5 and 50 mm. The width of the part of said guiding elements, which is adapted for being inserted in said openings in the sash, in a width direction, which is substantially parallel to the pane plane, is between 1 and 20 mm, preferably between 3 and 15 mm and most preferably between 5 and 10 mm. These dimensions will be well suited for use in standard size roof windows used in residential buildings, but larger dimensions may be necessary for larger windows and vice versa for windows of relatively small dimensions.

The comparatively small dimensions of the projecting guiding elements in relation to typical sash members means that thermal bridges are substantially prevented.

Some or all guiding elements may be separate and independent from the elongate support member(s) in order to allow for more flexible solutions, and different kinds of guiding elements may be used in the same pane module, just as the number of guiding elements may vary depending on different design requirements, even if the pane element is of the same size.

In a pane module for use in a centre-hung roof window to be installed in an inclined roof, it will usually be advantageous to provide guiding elements at the corners of the pane element and at the mid-points between the corners. In such embodiments the guiding elements arranged along the intended sides of the window can be connected to the elongate support members, while the guiding members arranged at the middle of the top and bottom members are connected directly to the moulded part of the border element.

Above, reference has been made to the pane module being connected to a sash of a window. Typically, this sash will be a movable sash, which is connected to a frame via hinges in the mounted condition, but the pane module may also be connected to a stationary frame, thereby forming a window, which cannot be opened.

Other embodiments of the invention and further advantages will be apparent from the following detailed description and the dependent claims.

BRIEF DESCRIPTION OF DRAWING

The invention will now be described in more detail with reference to non-limiting embodiments shown in the schematic drawing, in which.

DETAILED DESCRIPTION OF THE INVENTION

Figure 1:
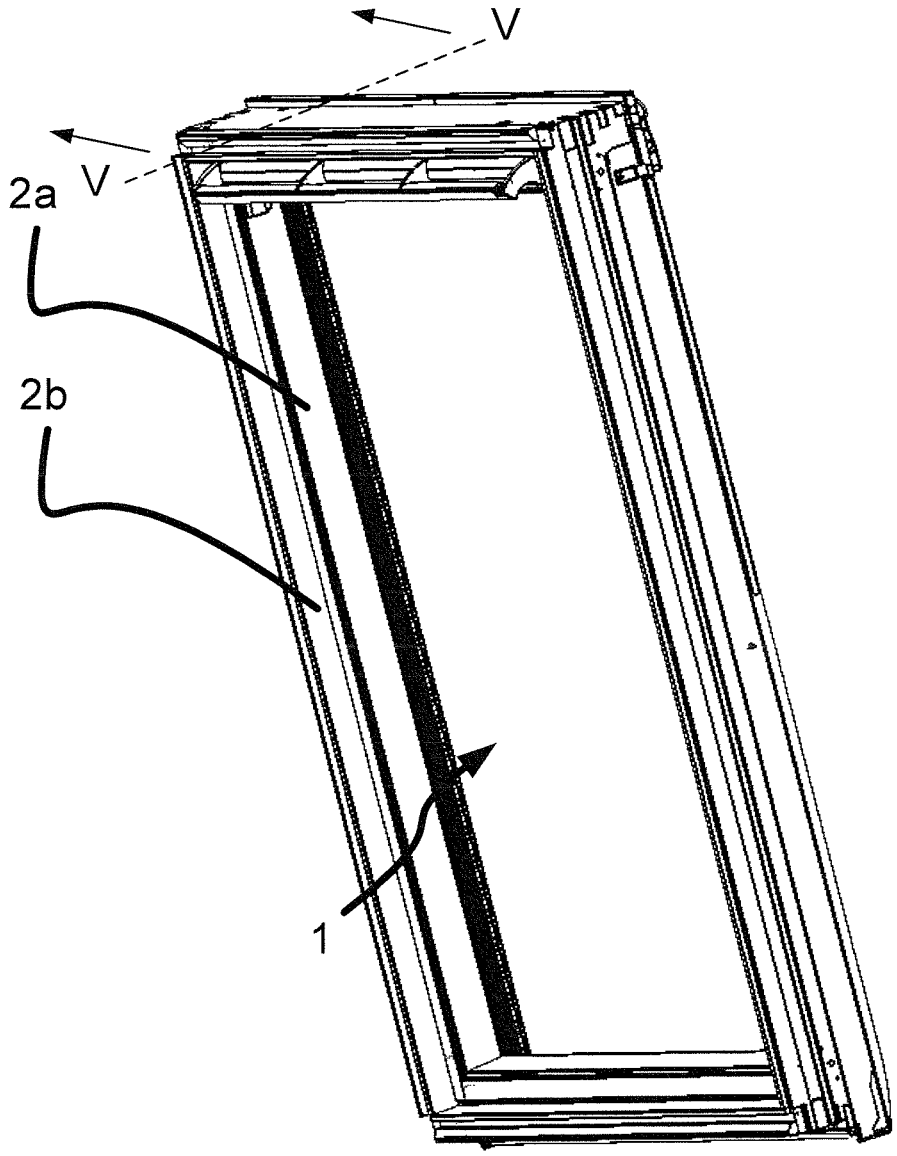
FIG. 1 is a perspective view of a roof window.

A window with a pane module 1 according to the invention is shown in FIG. 1. The pane module 1 is mounted on a sash 2*a*, which is connected to a stationary frame 2*b* via a set of hinges (not shown).

Figure 2:
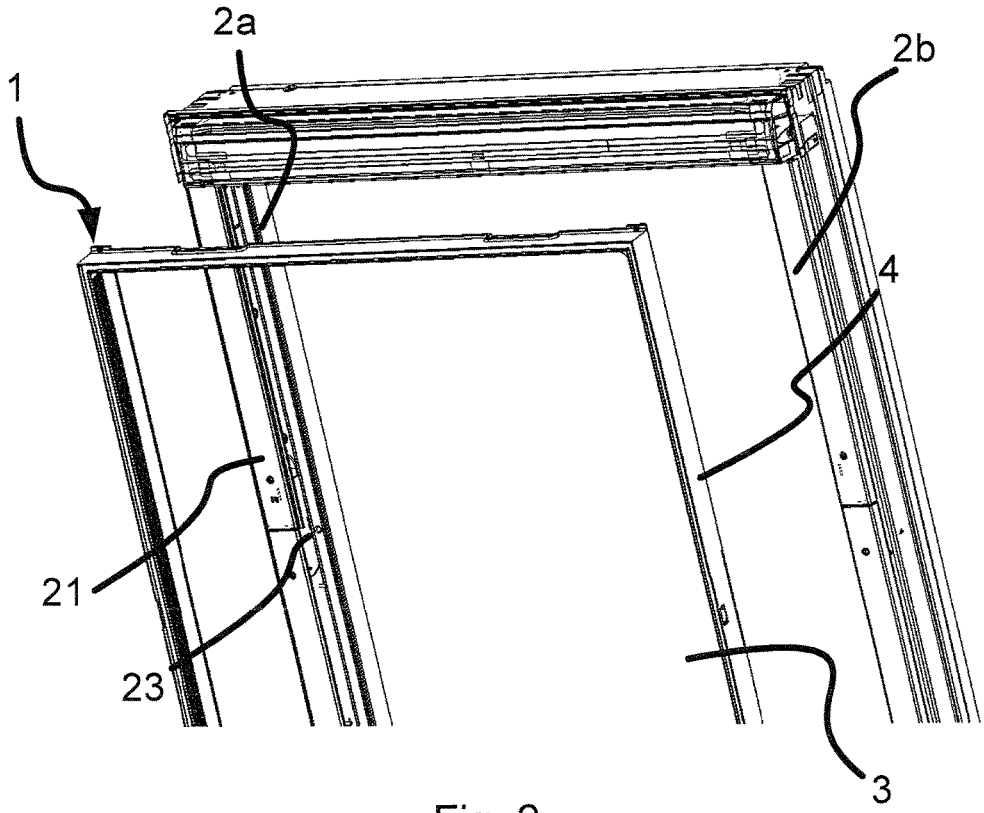
FIG. 2 is an exploded, partially cut-away view of the roof window in FIG. 1 seen from the opposite side.
Figure 3:
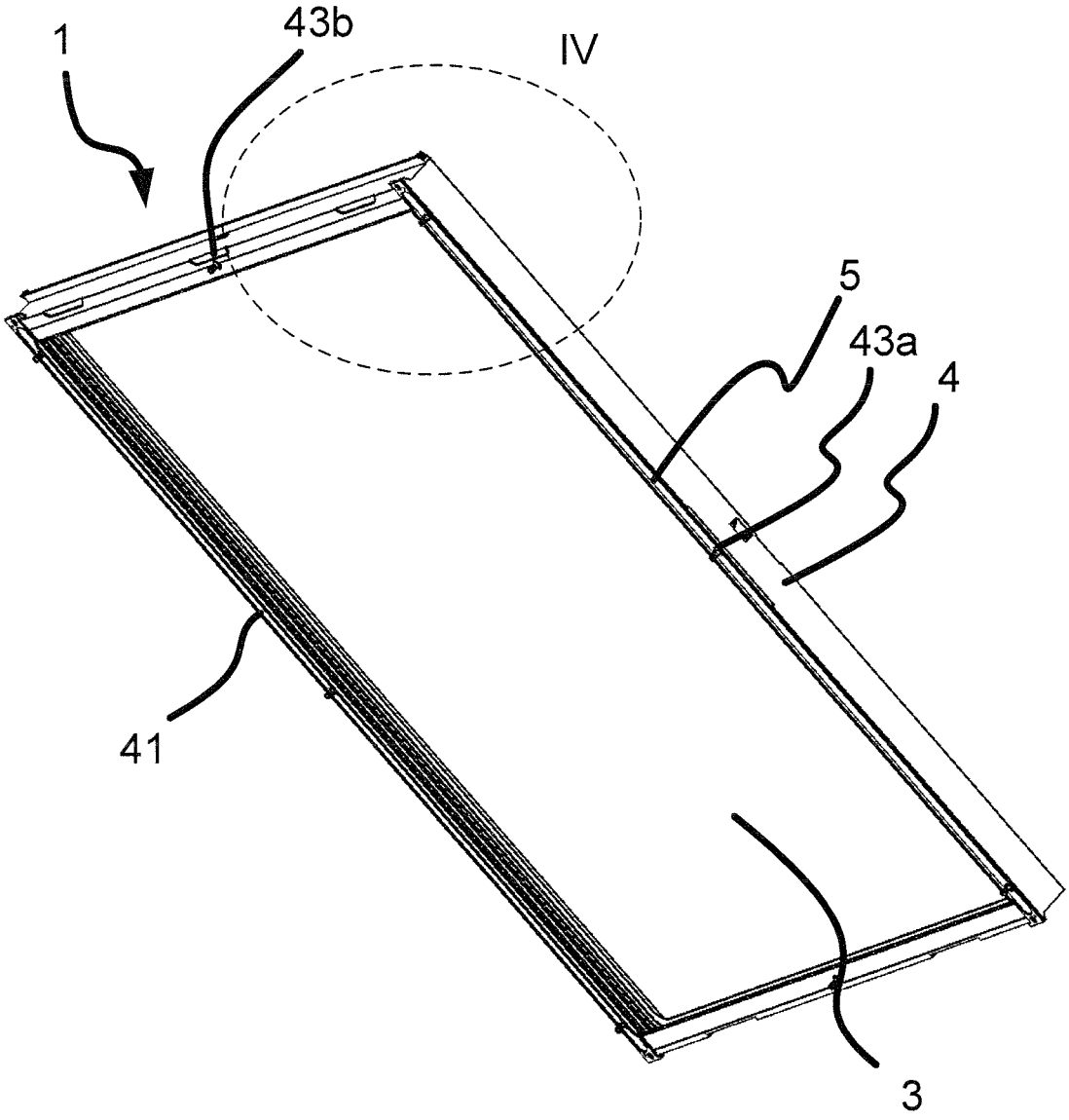
FIG. 3 is a perspective view of a pane module with projecting guiding elements.
Figure 5:
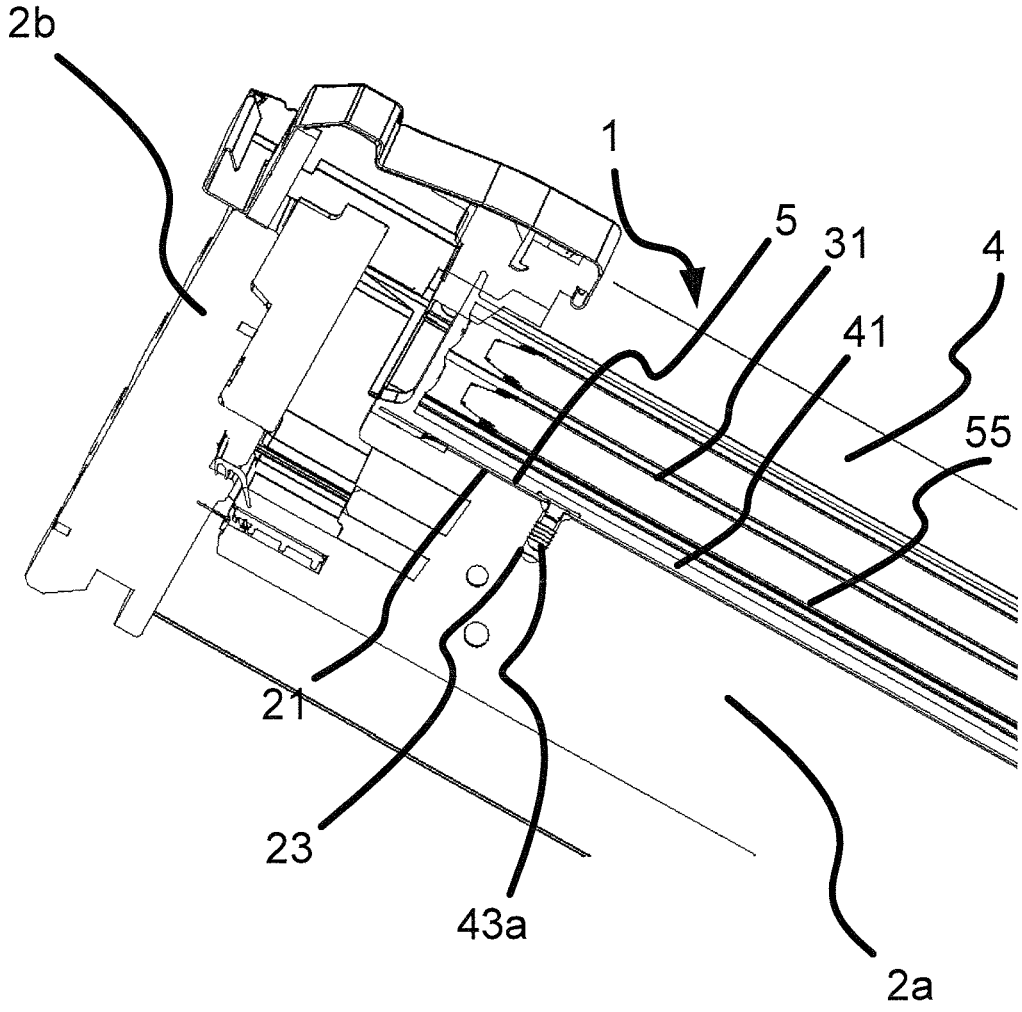
FIG. 5 is a cross-sectional view along the line V-V in FIG. 1.

The window of FIG. 1 is shown in an exploded view in FIG. 2, where the pane module 1 and the sash 2*a* are shown separated from each other, and the pane module is shown alone in FIG. 3. As may be seen, the pane module 1 comprises a pane element 3 and a border element 4, where the border element is composed of a top member, a bottom member and two side members extending between the top and bottom members, thus surrounding the pane element 3 along all four sides. In this embodiment the pane element 3 includes four sheet elements in the form of sheets of glass, separated by one or more spacer members 31 as shown in FIG. 5, and the border element 4 encases the edges of all sheet element, but in other embodiments one or more sheet elements may be free of the border element along one or more sides. The border element 4 is made by moulding and attached to the pane element 3 during the moulding process, and other elements such as hinges or mounting brackets may be encased therein as well.

In the mounted state shown in FIG. 1, a contact surface 41 of the border element 4, which can be seen in FIG. 2, is in contact with a contact surface 21 of the sash. The contact surface 41 of the border element 4 and/or the contact surface 21 of the sash 2*a* is/are provided with an adhesive or glue in order to attach the pane element 1 to the sash 2*a*.

The adhesive or glue may be any, which is resistant to the climate conditions found on the roof of a building, particularly temperature variations, high humidity levels, and ultra violet radiation, and preferably also has good insulating properties.

Figure 4:
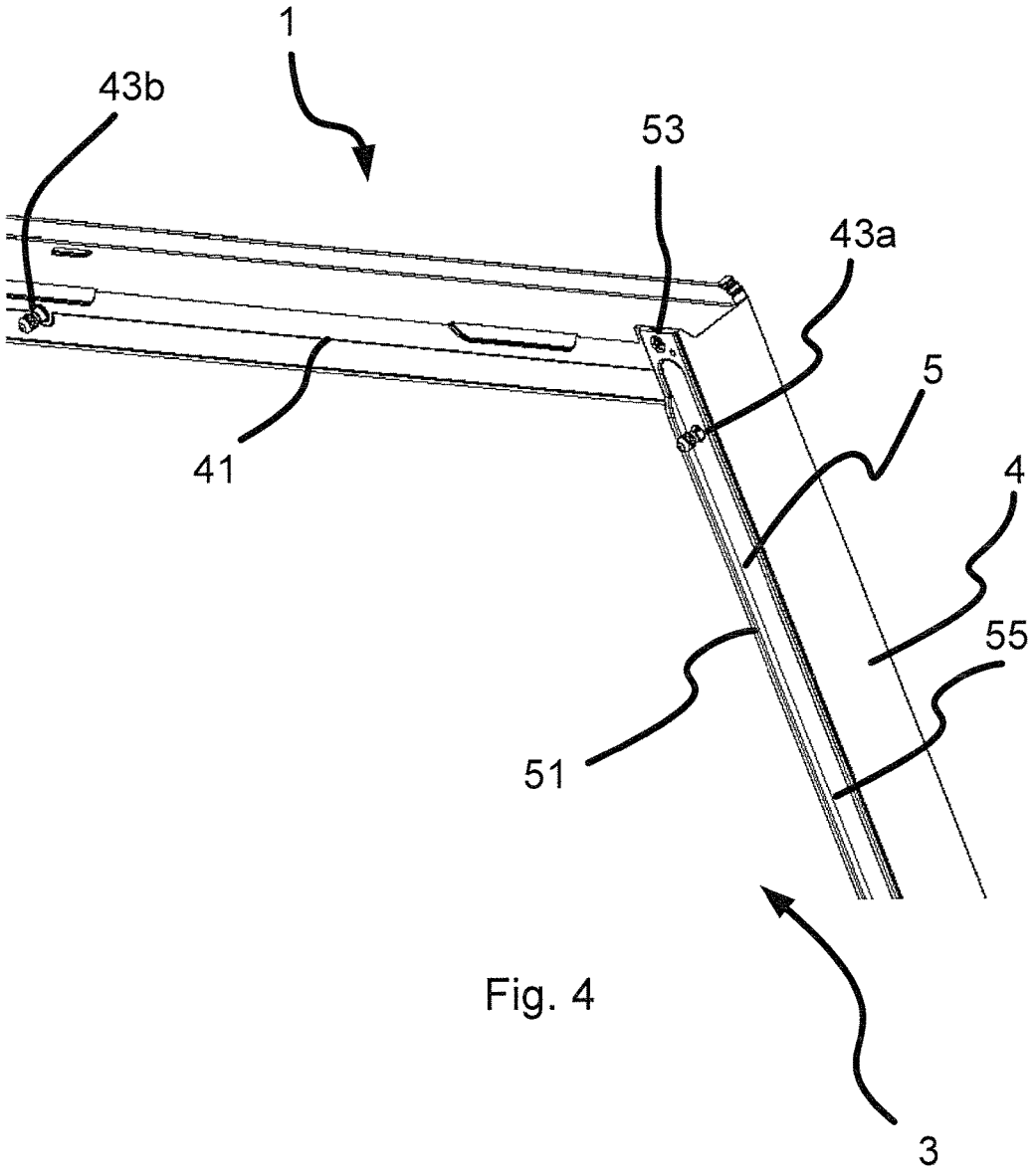
FIG. 4 is a close-up perspective view of the detail marked IV in FIG. 3.

As is seen in FIGS. 3 and 4 the pane module 1 of FIG. 1 and FIG. 2 includes two elongate support members 5, which are arranged to extend along the sides of the pane element 3 and embedded in the material of the border element 4. Other parts may also be embedded in the border element 4 in order to make more compact and simpler designs. Each of the elongate support members 5 extend substantially along the entire length and width of a side member of the border element 4. In this embodiment the elongate support members 5*a* are encased in the border element 4 and arranged such that they are partially exposed so that they will come into contact with the adhesive or glue. In other embodiments the elongate support members 5 may be smaller or bigger, in the length and/or width dimension, than the border element 4. It is, however, presently preferred to keep the elongate support member 5 slender in order to avoid thermal bridges in the window assembly.

In this embodiment, the pane module 1 includes only two support members, but in other embodiments the pane module 1 may comprise three, four or more elongate support members 5. In a still further embodiment one L- or U-shaped elongate support member (not shown) extends along more than one side of the pane element.

Figure 6:
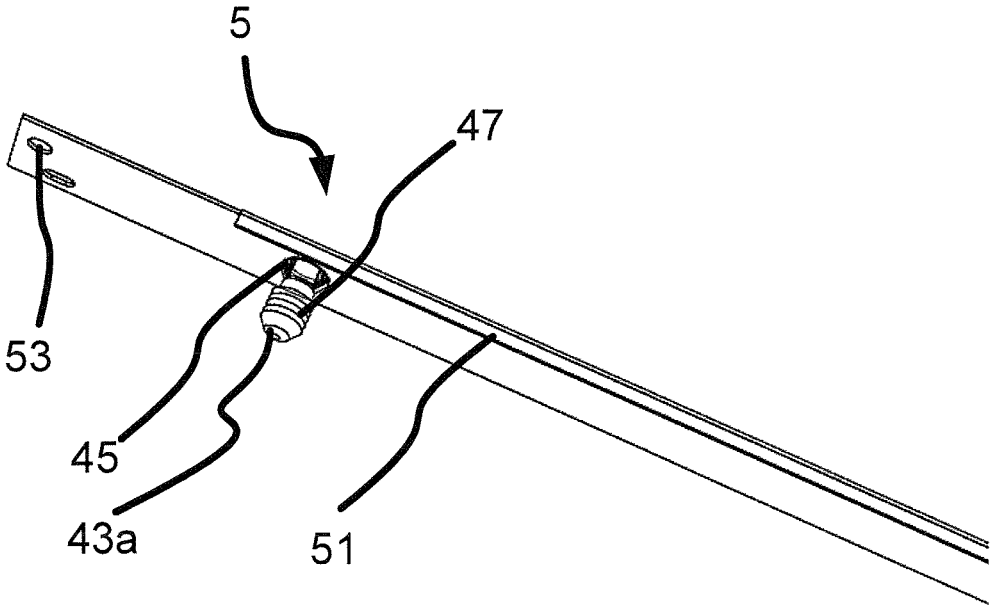
FIG. 6 is a perspective, partially cut-away view of an elongate support member with a guiding element projecting through a hole therein.
Figure 7:
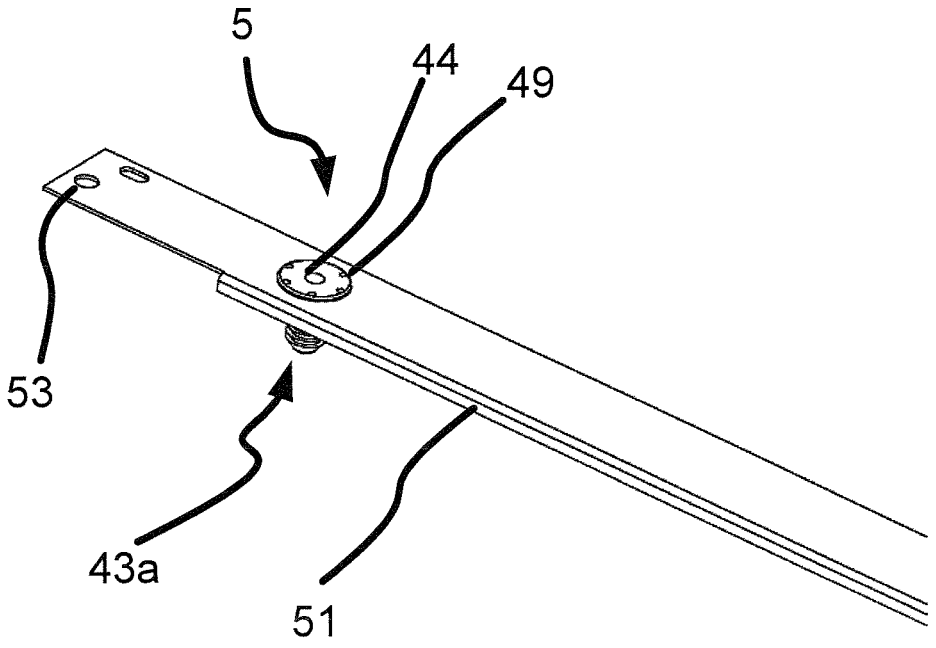
FIG. 7 is a perspective, partially cut-away view corresponding to the one in FIG. 7, but seen from the opposite side.

As may be seen in FIGS. 6-7 the elongate support member 5 in this embodiment comprises a reinforcing flange 51. The reinforcing flange 51 provides additional structural rigidity to the support member and hence to the pane module 1. Other embodiments (not shown) comprise several reinforcing flanges in order to add further structural rigidity and still other are devoid of reinforcing flanges if the structural rigidity is sufficient without reinforcing flange. Another embodiment where the elongate support member 5 only serves to provide tensile strength is also conceivable. In such an embodiment the elongate support member 5 could be made out of a light and strong material such as glass fibres, carbon fibres, organic fibres or the like or of composites including such materials.

Each of the elongate support members 5 shown in the embodiment on FIG. 3-7 comprise one or more holes 53 in order to allow screws or the like fasteners to be inserted through the support member 5 and into the sash 2*a*. The screws inserted into the one or more holes 53 provide an additional support for the pane module 1 during the setting or hardening of the adhesive or glue, by taking up the forces pulling the contact surface 41 of the border element 4 away from or sideways in relation to the contact surface 21 of the sash 2*a*. The screws inserted into the one or more holes 53 may also serve as an additional security when the pane module 1 is installed on the sash 2*a*.

As it is best seen in FIG. 4, the contact surface 41 of the border element may be provided with recesses 55 for accommodating adhesive or glue. The elongate support member 5 and the contact surface 21 of the sash 2*a* may also in other embodiments (not shown), be provided with recesses for accommodating adhesive or glue. The recesses 55 make it possible to allow more adhesive or glue for the fastening of the pane member 1 on the sash 2*a*. The recesses 55 also provide more surface area, providing a stronger fixation between the parts.

The pane module 1 further comprises guiding elements 43*a*, 43*b* projecting, from the contact surface 41 of the border element 4, substantially perpendicularly to the pane plane and are inserted in openings 23 in the contact surface 21 of the sash 2*a*. The guiding elements 43*a*, 43*b* guide the pane module 1 when being attached to the sash 2*a*, in order to aim and place the pane module 1 into the correct position. The guiding elements 43*a*, 43*b* ensure that the contact surface 41 of the border element 4 is in contact with the contact surface 21 of the sash 2*a* until the adhesive or glue has set or hardened.

Some of the guiding elements 43*b* shown are simply encased in the moulded border element 4, while others are inserted 43*a* in openings in the elongate support member 5, as seen in FIGS. 3-7, for additional support.

Figure 8:
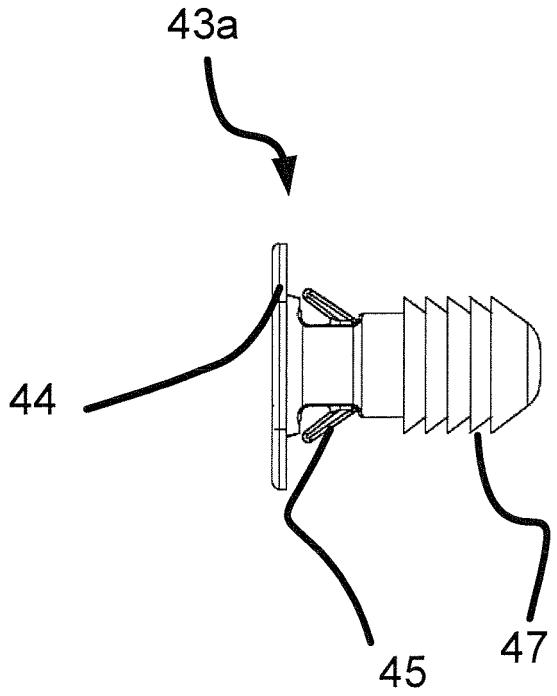
FIG. 8 shows the guiding element in FIGS. 6 and 7 in an enlarged side view.

In FIG. 6, which is a bottom view of the elongate support member 5, an embodiment where a guiding element 43*a* is inserted through an opening of the elongate support member 5 is shown. In this embodiment the guiding element 43*a* has head barbs 45 functioning as anti-extraction barbs as seen on FIGS. 6 and 8. The head barb 45 retains the guiding element 43*a* when inserted through an opening in the elongate support member 5.

Figure 9:
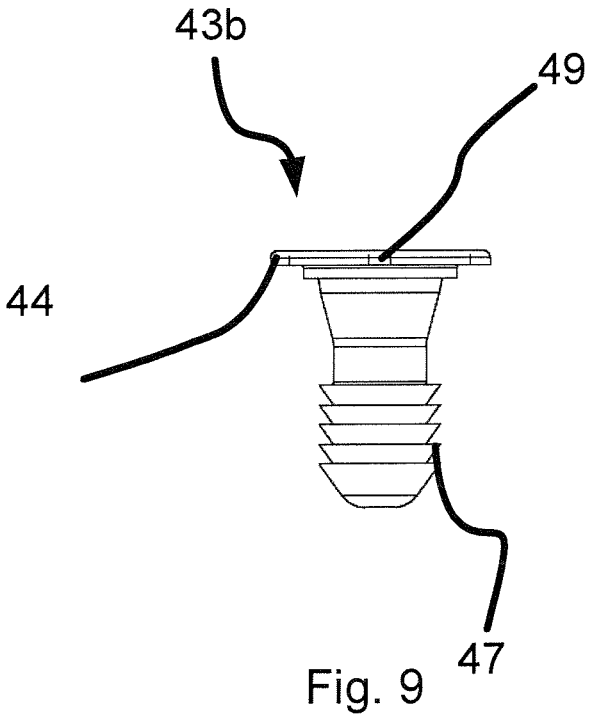
FIG. 9 shows an alternative embodiment of a guiding element in a side view.

In another embodiment, a guiding element 43*b*, which is devoid of head barbs 45, is shown in FIG. 9. This embodiment is well suited for being encased in the moulded border element 4 without first being connected to a support member.

The guiding elements 43*a*, 43*b* shown also have body barbs 47 adapted for retaining the guiding elements 43*a*, 43*b* when inserted in the openings 23 of the sash 2*a*, by acting as anti-extraction barbs.

Each of the guiding elements 43*a*, 43*b* shown further has a head 44, which is wider than the part of the guiding element, which is intended for being inserted in an opening in the sash 2*a*.

FIG. 7 shows a top view of the embodiment from FIG. 6, where a guiding element 43*a* is inserted through an opening of the elongate support member 5. In this embodiment the head 44 prevents the guiding element from passing all the way through the hole in the elongate support member 5, and may thus be said to have a barb function on the other side of the hole in the elongate support member 5 relative to the head barbs 45. The head 44 and the head barbs 45 have in this embodiment the function of securing the guiding element 43*a* to the elongate member 5. The relatively large width of the head 44 also provides a good contact between the guiding element 43 and the elongate support member 5, which may contribute to transmitting loads from the guiding element 43 to the support member 5.

The head 44 on the embodiment of the guiding element 43*b* in FIG. 9 also serves as a barb and as a load distributing element, when the guiding element 43*b* is encased in the border element 4.

The head 44 of both embodiments of the guiding element 43*a*, 43*b* are provided with holes 49. When encasing the guiding element 43 in the moulded border element 4, the moulding material will penetrate wholly or partially into these holes. This will contribute to a particularly good connection between the guiding elements 43 and the moulded border element 4, which will be able to transmit both shearing forces and rotational forces. It will, however, be understood that the guiding elements may also be made without such holes and that it may even be advantageous in some embodiments to avoid adhesion of the moulding material to the guiding elements, so that they may rotate freely.

The guiding elements 43*a*, 43*b* shown are relatively short compared to the thickness of the sash 2*a* in order to avoid thermal bridges. The length of the guiding elements 43*a*, 43*b* should preferably not be longer than approximately ⅓ of the thickness of the sash 2*a*.

The invention claimed is:

1. A method for attaching a pane element to a sash, including the steps of:

A) providing a pane element with a border element, thereby making a pane module where the pane element includes at least two sheet elements, separated by one or more spacer members, where an interior side of the pane element is intended to face the interior of a building in a mounted state and defines a pane plane, where the border element surrounds the pane element, at least partially encasing an edge of at least one sheet element, and where the border element is made by moulding and attached to the pane element during the moulding process, B) bringing a contact surface of the border element into contact with a contact surface of the sash, and connecting the pane module to the sash, characterized in that during step A) one or more elongate support members is/are arranged to extend along one or more sides of the pane element and at least partially embedded in the material of the border element during the moulding process, and that step B) includes the following steps:

B1) providing the contact surface of the border element and/or of the sash with an adhesive or glue, B2) inserting guiding elements of the border element in openings in the contact surface of the sash, said guiding elements projecting from the contact surface of the border element, and B3) keeping the contact surface of the border element in contact with the contact surface of the sash until the adhesive or glue has set or hardened, where, during step A), the guiding elements are inserted through one or more holes in the one or more elongate support members.

2. The method according to claim 1, wherein the one or more elongate support member(s) is/are arranged at the contact surface of the border element, and a portion of the one or more elongate support member(s) is exposed in the finished state of the pane module so that the portion of the one or more support member(s) comes into contact with the adhesive or glue during step B).

3. The method according to claim 2, where during step B2) the guiding elements are brought into a tensioned engagement with inside surfaces of said openings, said inside surfaces being substantially perpendicular to the sash contact surface.

4. The method according to claim 3, wherein step B) further includes a step B4), where one or more fasteners are inserted through one or more holes in the elongate support member and into the sash, said step B4) being performed either between steps B2) and B3) or after step B3).

5. A pane module adapted to be installed on a sash and comprising a pane element and a border element, where the pane element includes at least two sheet elements, separated by one or more spacer members, where an interior side of the pane element is intended to face the interior of a building in a mounted state and defines a pane plane, where the border element surrounds the pane element, at least partially encasing an edge of at least one sheet element, where the border element is a moulded border element, and means for attaching the border element to the pane element, said means for attaching being moulding, and where the border element includes a contact surface adapted for being connected to a contact surface of the sash, characterized in that the contact surface of the border element is adapted for being connected to the contact surface of the sash by means of an adhesive or glue, that the border element includes one or more elongate support member(s) having one or more openings, and that the border element comprises guiding elements extending through one or more openings of the one or more elongate support member(s) and projecting from the contact surface of the border element substantially perpendicularly to the pane plane, said guiding elements being adapted for being inserted in openings in the contact surface of the sash.

6. The pane module according to claim 5, wherein the elongate support member(s) is/are arranged at the contact surface of the border element, and at least partially exposed.

7. The pane module according to claim 6 wherein, said elongate support member comprises recesses for accommodating adhesive or glue.

8. The pane module according to claim 7, wherein said elongate support member(s) extend(s) substantially along the entire length and/or width of the pane element.

9. The pane module according to claim 8, wherein, said elongate support member comprising one or more holes adapted for receiving one or more fasteners for a temporary fastening of the border element to a sash.

10. The pane module according to claim 9, wherein a portion of said guiding elements, which is adapted for being inserted in said openings in the sash, is provided with barbs.

11. A method for attaching a pane element to a sash, including the steps of:

A) providing a pane element with a border element, thereby making a pane module where the pane element includes at least two sheet elements, separated by one or more spacer members, where an interior side of the pane element is intended to face the interior of a building in a mounted state and defines a pane plane, where the border element surrounds the pane element, at least partially encasing an edge of at least one sheet element, and where the border element is made by moulding and attached to the pane element during the moulding process, B) bringing a contact surface of the border element into contact with a contact surface of the sash, and connecting the pane module to the sash, characterized in that during step A) one or more elongate support members having one or more holes is/are arranged to extend along one or more sides of the pane element and partially embedded in the material of the border element during the moulding process, and that step B) includes the following steps:

B1) providing the contact surface of the border element and/or of the sash with an adhesive or glue, B2) inserting guiding elements of the border element in openings in the contact surface of the sash, said guiding elements projecting from the contact surface of the border element wherein at least a portion of each of said guiding elements extends into one of the one or more holes of the one or more elongate support members such that each of said guiding elements extends through the contact surface of the border element and the contact surface of the sash, and B3) keeping the contact surface of the border element in contact with the contact surface of the sash until the adhesive or glue has set or hardened.

* * * * *